US008376046B2

(12) United States Patent
Broussard, II

(10) Patent No.: US 8,376,046 B2
(45) Date of Patent: Feb. 19, 2013

(54) FRACTIONATION SYSTEM AND METHODS OF USING SAME

(76) Inventor: Wayne F. Broussard, II, Houma, LA (US)

( * ) Notice: Subject to any disclaimer, the term of this patent is extended or adjusted under 35 U.S.C. 154(b) by 290 days.

(21) Appl. No.: 12/799,421

(22) Filed: Apr. 26, 2010

(65) Prior Publication Data

US 2011/0259584 A1 Oct. 27, 2011

(51) Int. Cl.
*E21B 43/26* (2006.01)

(52) U.S. Cl. ..... 166/308.1

(58) Field of Classification Search ..... None
See application file for complete search history.

(56) References Cited

U.S. PATENT DOCUMENTS

| | | | | |
|---|---|---|---|---|
| 4,109,721 | A | 8/1978 | Slusser | |
| 4,583,170 | A | 4/1986 | Carlin et al. | |
| 4,588,509 | A * | 5/1986 | Hyde et al. | 210/788 |
| 4,898,240 | A | 2/1990 | Wittrisch | |
| 4,898,241 | A | 2/1990 | Wittrisch | |
| 5,202,680 | A | 4/1993 | Savage | |
| 5,984,578 | A | 11/1999 | Hanesian et al. | |
| 6,722,437 | B2 | 4/2004 | Vercaemer et al. | |
| 6,732,799 | B2 | 5/2004 | Challacombe | |
| 6,776,235 | B1 | 8/2004 | England | |
| 6,782,948 | B2 | 8/2004 | Echols et al. | |
| 6,985,750 | B1 | 1/2006 | Vicknair et al. | |
| 7,082,993 | B2 | 8/2006 | Ayoub et al. | |
| 2003/0075328 | A1 | 4/2003 | Challacombe | |
| 2003/0205376 | A1 | 11/2003 | Ayoub et al. | |
| 2005/0234648 | A1 | 10/2005 | Economides et al. | |

* cited by examiner

*Primary Examiner* — Zakiya W Bates
(74) *Attorney, Agent, or Firm* — The Matthews Firm

(57) ABSTRACT

A fractionation system having a fractionation manifold with a plurality of connectors in fluid communication with one another and a plurality of valves disposed adjacent the connectors for selectively flowing fluid through the manifold. The connectors define a plurality of exterior ports for communication with wellstrings and fracturing fluid sources. A primary choke in communication with a tubing string and a secondary choke in communication with a casing string can be engaged with exterior ports, the secondary choke useable as a backup choke and for inducing sandouts. The present system can achieve a flow rate of up to 80 barrels per minute, or more, using only a single manifold and single power unit, and can be wirelessly operated. System components can incorporate self-aligning, self-positioning skids, or alternatively, the system can be transported using a single skid to facilitate portability and installation.

7 Claims, 5 Drawing Sheets

FRACTIONATION SYSTEM AND METHODS OF USING SAME

FIELD

The present disclosure relates, generally, to fractionation systems for fracturing a well and related methods of use.

BACKGROUND

To increase production of a well, it is often necessary to fracture the well, which is performed by flowing fracturing fluid into the earth to mechanically create cracks in the ground. Fracturing fluid typically includes a liquid mixed with sand, small ceramic beads, or similar proppant material, which creates pressure within the well as the fluid accumulates, until the pressure causes cracks to form in the earth, or causes existing cracks in the earth to widen, thereby increasing the flow of hydrocarbons from the well.

Conventionally, when fracturing a well, numerous manifolds, i.e. a pumping manifold, a flowback manifold, a choke manifold, and other manifolds, must be installed at the wellhead surface, which can require six to eight hours, or longer, numerous personnel, and a large amount of space on a rig floor. Additionally, each manifold requires a series of hydraulic conduits or similar connections to enable actuation of the manifold, which further consumes limited space proximate to a wellhead and can create a safety hazard.

Fractionation manifolds typically include a series of valves and connectors used to flow fracturing fluid from a fluid vessel into the wellhead. Fluid is then retrieved from the wellhead and is flowed through different valves into a choke, which controls the back pressure on the well and ensures the flow of fluid directly through the choke. Sand, beads, and other particulates in the fluid are sent through a reverse line overboard, or to a pickle return tank, while the fluid, itself, can be reclaimed through a separate reverse line to the rig pits for treatment. Operation of the valves and chokes normally requires at least one operator, on-site, to manipulate appropriate hydraulic, electrical, and/or manual parts of the manifolds. Often, the one or more operators can be subject to inclement weather, and potential safety risks when manipulating the manifolds.

To reduce the possibility of choke failure, many fractionation manifolds incorporate use of an auxiliary choke. The primary and auxiliary chokes both communicate with the tubing string of the well, so that the auxiliary choke can be engaged if the primary choke fails.

A typical fractionation system, especially a system incorporating a second choke, is extremely large, cumbersome, and expensive, containing a large number of valves and connectors, and requiring a large number of hoses and conduits to ensure sufficient electrical and/or hydraulic connections. Additionally, most fractionation manifolds are difficult and time consuming to properly install, each valve and component requiring precise alignment using cranes and other devices adapted for manipulation of the heavy components. Further, most fractionation manifolds are limited regarding the orientation with which components can be installed and engaged, which can become a hindrance on offshore rigs and other drilling sites where space is limited. Also, most fractionation manifolds require on-site personnel to actuate valves, chokes, and other parts of the manifolds, increasing the time required for each operation, and the inherent risk to the operators.

Also, a typical fractionation system is limited to a flow rate of approximately 30 barrels of fluid per minute. When additional flow is necessary, multiple manifolds are used, increasing the time, expense, and space required, and necessitating additional cumbersome installation and operating procedures necessary to fracture and produce a well.

A need exists for a fractionation system that can be used to perform the functions of numerous manifolds using a single, readily transportable system that is efficient to install, remotely operable, and able to exceed the flow capacity of conventional manifolds while eliminating the need for numerous hydraulic and electrical lines, and the need for operators to be present on the rig floor during the fractionation process, thereby providing a significant safety benefit.

A need also exists for a fractionation system that can advantageously utilize limited space at a drilling site by enabling selective engagements of differing orientation between fractionation manifolds and chokes.

A further need exists for a fractionation system that can incorporate a second choke that is in communication with the casing of a drill string, rather than the tubing string, that is useable both as a backup choke during primary choke failure, and that is separately useable during sandouts to remove excess return fluid from a well.

An additional need exists for a fractionation system that is modular, able to be efficiently and easily aligned and installed through use of interlocking skids, or alternatively, a single unitary skid or similar transport member, that is able to accommodate flow rates in excess of conventional manifolds using only a single fractionation manifold and a single power unit.

Embodiments of the present invention meet these needs.

SUMMARY

Embodiments of the present invention relate, generally, to a fractionation system that includes a fractionation manifold having a plurality of connectors, each in fluid communication with each other connector. The fractionation manifold also includes a plurality of valves, with each of the connectors having at least one valve disposed adjacent thereto, such that any two connectors have a valve disposed therebetween. Ports of the connectors that do not engage adjacent valves define a plurality of exterior ports, useable to engage chokes, fluid sources, wellstrings, and other system components.

A primary choke, in communication with a wellbore tubing string, can be provided in communication with a first of the exterior ports. Additionally, in an embodiment of the invention, a secondary choke, in communication with the casing string disposed about the tubing string, can be provided in communication with a second of the exterior ports, useable both during sandouts and as a backup choke during periods when the primary choke is inoperable.

In a preferred embodiment of the invention, one or more of the valves and/or one or both of the chokes can be actuated wirelessly, thereby enabling a single remote operator to cause the fractionation system to perform any desired function, and to regulate the pressure and flow rates throughout the system, without requiring hydraulic or electrical lines, or other conduits that undesirably occupy space on a rig floor, and without requiring the presence of any personnel on the rig floor, thereby providing an immense safety benefit over conventional systems. While manually actuatable units could also be used to control the valves and/or chokes, as could one or more umbilical units, wireless control enables a single remote operator, located away from the rig floor, to monitor and control the state of one or more valves or chokes within the system, pressure within one or more portions of the system, the remaining power of a power source used to power one or more portions of the system, or combinations thereof.

In an embodiment of the invention, the fractionation manifold can incorporate use of one or more five-way connectors, which enable chokes, additional manifolds or other connectors, and other system components to be engaged with the fractionation manifold from any direction, including vertical directions, as needed, thereby conserving space at a drilling site and enabling the present system to flexibly occupy small or irregularly-shaped spaces.

Through use of a single exterior port of the fractionation manifold to flow fracturing fluid into a well, embodiments of the present fractionation system can flow approximately 30 barrels per minute. However, if a second exterior port is utilized to flow fracturing fluid, embodiments of the fractionation system can flow 50 barrels per minute, or more.

In an embodiment of the invention, the fractionation system can further include a third exterior port, which can be provided through an integral or external "shotgun" manifold, useable to increase the flow capacity of the system to 80 barrels per minute, or more. The shotgun manifold can include at least one additional connector, placed in fluid communication with each other connector of the manifold, and at least one valve. The shotgun manifold thereby defines one or more additional exterior ports, useable to flow fracturing fluid, thereby increasing the flow capacity of the fractionation system. The shotgun manifold can also be controllable using a wireless unit, in the manner described previously.

The entire fractionation system, including a shotgun manifold, if used, can be powered using a single power unit, which can include one or more batteries, hydraulic units, solar panels, alternating current, direct current, or combinations thereof. Through use of a shotgun manifold, as described previously, a second fractionation manifold with an additional power unit is not necessary to increase the flow capacity of the system.

In an embodiment of the invention, the fractionation manifold, the primary and secondary chokes, and the shotgun manifold, if used, could each be disposed in a skid, each skid having aligning and positioning members for interconnecting adjacent skids to ensure proper alignment and distancing of system components. The aligning and positioning members can include a generally U-shaped, hook-like member secured to a first skid used to attach over a horizontal frame member of an adjacent skid. Through use of self-aligning, self-positioning skids, the present fractionation system can be installed rapidly and efficiently, without requiring tedious lifting and repositioning of components to obtain proper alignment. When the skids are interconnected, all system components that require precision alignment and spacing prior to manual engagement, such as through threaded hammer unions, are aligned with the necessary angle and distance, on either side of the fractionation manifold.

Alternately, in a preferred embodiment of the invention, one or more of the fractionation manifold, primary choke, secondary choke, and/or shotgun manifold could be disposed within a single skid or similar transport member, or use of skids and similar members could be omitted. The portability and transportability of the fractionation system enables the system to be lifted, transported, and installed rapidly, using a minimum number of operators and a minimum number of lifting operations, while conventional fracturing operations would require six to eight hours, or longer, to install each of the required manifolds. In an embodiment, the present system can be installed by a single operator using only a single lifting operation. For purposes of this disclosure, "minimum" can be defined as one or more personnel and/or lift operations fewer (though at least one) than what would be required to install an alternate fractionation manifold having a comparable flow capacity, and all related components.

In use, a fractionation system, as described previously, can be provided, the system including a fractionation manifold, a primary choke, a secondary choke, and at least one source of fracturing fluid. Fracturing fluid sufficient to fracture the well is introduced into the fractionation manifold by selectively manipulating valves within the manifold. Return fluid is flowed from the well via the primary choke, the secondary choke, or combinations thereof, and the connector valves are selectively manipulated to flow the return fluid to a repository. Actuation of the valves can be accomplished using one or more wireless units, or other control units, as described previously.

In an embodiment of the invention, the connector valves can be selectively actuated to flow fluid from the secondary choke during a sandout. The secondary choke can also be used to flow fluid from the casing string during normal operations.

In a further embodiment of the invention, one or more additional exterior ports, such as through use of a "shotgun" manifold, as described previously, can also be provided, enabling fracturing fluid to be flowed at a rate of up to 80 barrels per minute, or more.

Embodiments of the present invention thereby provide fractionation systems and related methods that can perform the functions of multiple manifolds normally required for a fracturing operation, while accommodating flow rates exceeding that of conventional manifolds using only a single power unit, and enabling wireless control, thereby advantageously conserving spaced on a rig floor while eliminating the need for on-site personnel to manipulate parts of the system.

Further, embodiments of the present systems and methods enable system components to be engaged in numerous differing orientations to accommodate limited space at a drilling site, such as through use of five-way connectors or other connector types and arrangements that can enable selective horizontal and/or vertical placement of components.

Additionally, embodiments of the present systems and methods can utilize two chokes to enable fluid flow on through both the tubing and casing of a well, while conventional systems utilize secondary chokes only as a backup choke during primary choke failure. The choke on the casing side is useable to induce sandouts.

BRIEF DESCRIPTION OF THE DRAWINGS

In the detailed description of the embodiments of the present invention described below, reference is made to the accompanying drawings, in which.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments depicted and described, and that the present invention can be practiced or carried out in various ways.

Figure 1:
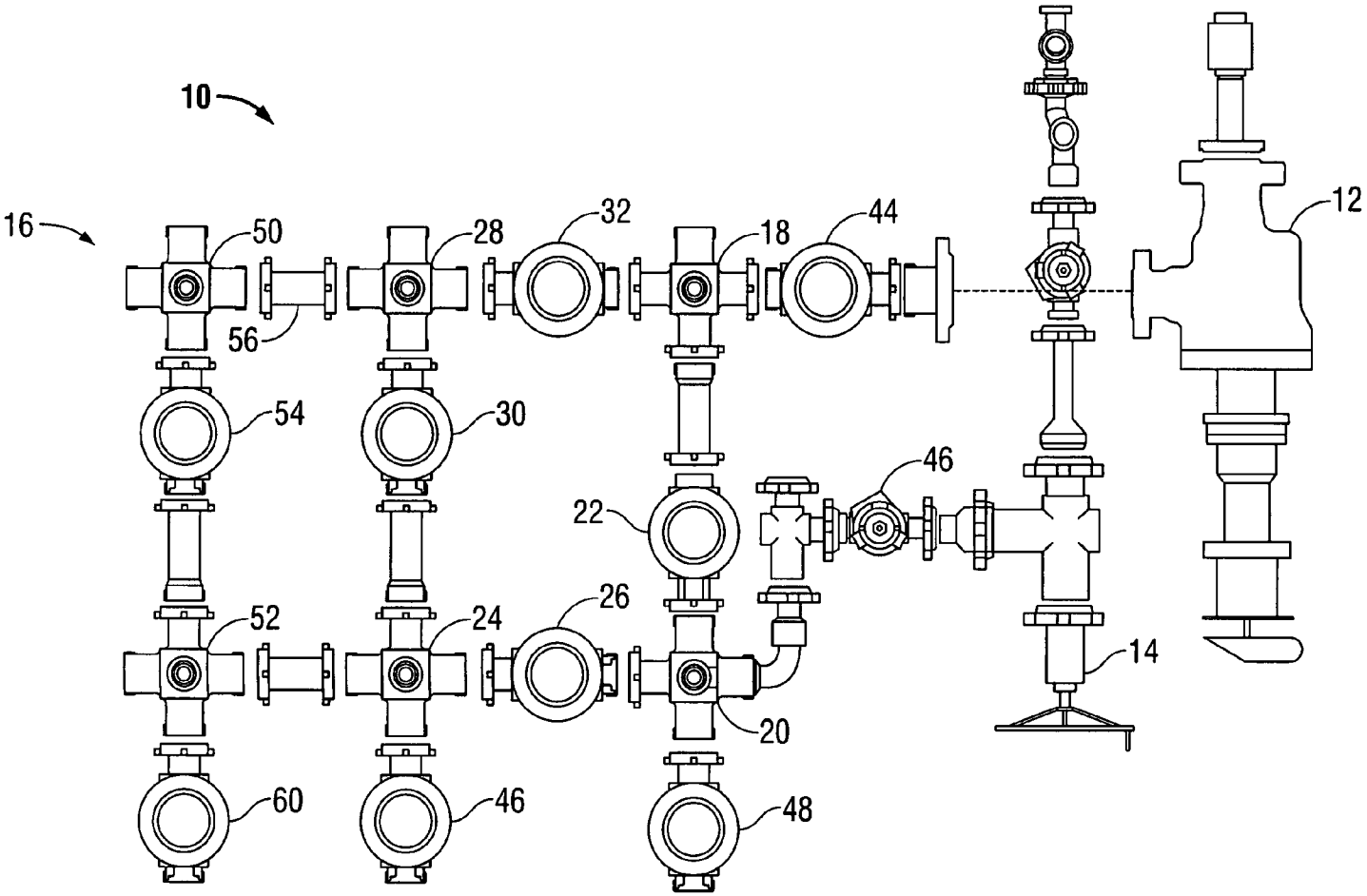
FIG. 1 depicts a diagram of an embodiment of a fractionation system useable within the scope of the present disclosure.

Referring now to FIG. 1, a diagrammatic top view of an embodiment of a fractionation system useable within the scope of the present disclosure is shown. The depicted embodiment includes a fractionation manifold (10) engaged with a primary choke (12), a secondary choke (14), and a shotgun manifold (16). Each of the manifolds (10, 16) is shown including numerous connectors having valves therebetween, while each of the chokes (12, 14) can include valves and other controllable elements, as known in the art. In a preferred embodiment of the invention, any of the valves and/or chokes are controllable wirelessly, enabling a single remote operator to monitor and control the pressure and flow rate throughout the system, and cause the depicted system to perform any desired function.

Specifically, FIG. 1 depicts the fractionation manifold (10) having a plurality of connectors in communication with a plurality of connector valves, which can include check valves, ball valves, gate valves, butterfly valves, or other similar types of valves able to be selectively actuated to permit fluid flow between adjacent connectors. While the type and orientation of the connectors used can vary, FIG. 1 depicts each of the connectors as a five-way connector, for accommodating any desired vertical or horizontal orientation of system components.

The fractionation manifold (10) is shown including a first five-way connector (18) in communication with and adjacent to a second five-way connector (20), with a first connector valve (22) disposed therebetween. A third five-way connector (24) is shown in communication with and adjacent to the second five-way connector (20), with a second connector valve (26) therebetween. A fourth five-way connector (28) is shown in communication with and adjacent to the third five-way connector (24), with a third connector valve (30) therebetween. The fourth five-way connector (28) is also in communication with and adjacent to the first five-way connector (18), with a fourth connector valve (32) disposed therebetween. It should be understood, however, that the depicted orientation of connectors and valves is exemplary, and that a fractionation manifold useable within the scope of the present disclosure can include any number, type, and configuration of valves and connectors.

In an embodiment of the invention, each five way connector (18, 20, 24, 28) can include four ports in a horizontal plane, each port substantially perpendicular to each adjacent port, and a fifth port vertically perpendicular to each of the horizontal ports. However, it should be understood that the orientation of each port of each connector can vary, and that useable connectors can include any member able to flow fluid, such as generally tubular components (two-way connectors), three-way connectors, or four-way connectors, having ports extending at any angle in relation to each other port.

Figure 2:
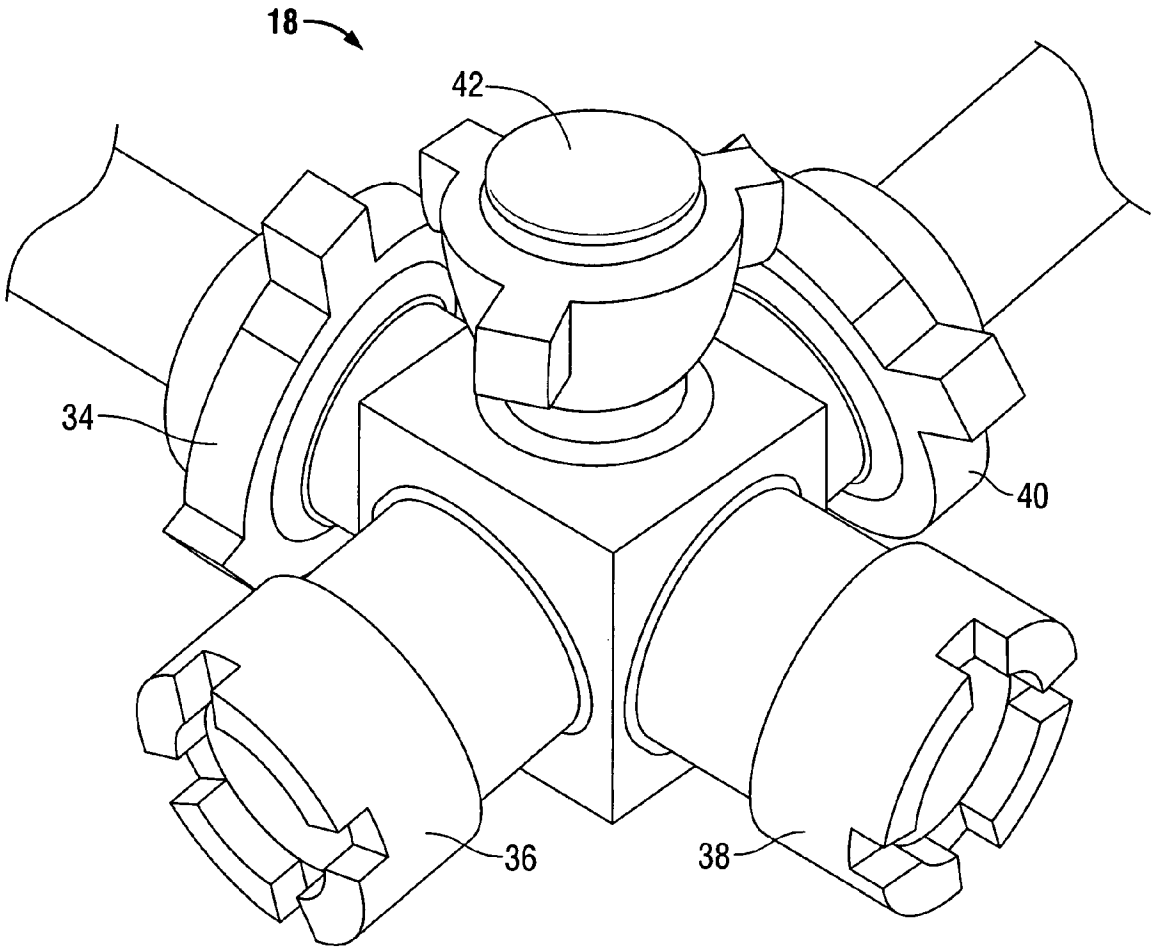
FIG. 2 depicts an embodiment of a connector useable with the fractionation system of FIG. 1.

FIG. 2 depicts an exemplary embodiment of a five-way connector (18) useable with the fractionation manifold of FIG. 1. The depicted five-way connector (18) has a first port (34), a second port (36) substantially perpendicular to the first port (34), a third port (38) substantially parallel to the first port (34) and perpendicular to the second port (36), and a fourth port (40) substantially parallel to the second port (36) and perpendicular to the first and third ports (34, 38). The first, second, third, and fourth ports (34, 36, 38, 40) are disposed in a horizontal plane. The depicted five-way connector (18) also has a fifth port (42), which is shown vertically perpendicular to each of the first, second, third, and fourth ports (34, 36, 38, 40).

The depicted orientation of ports disposed on the five-way connector (18) enables adjacent system components to be engaged with the five-way connector (18) from any direction, including a vertical direction, as needed, depending on the shape and availability of space at an operational site.

Returning to FIG. 1, each five-way connector (18, 20, 24, 28) of the fractionation manifold (10) is shown having five ports, similar to the depicted five-way connector of FIG. 2. As such, each five-way connector (18, 20, 24, 28) is shown engaging two adjacent connector valves, while retaining three exterior ports that are not engaged with connector valves. The exterior ports are useable for engagement with the primary and secondary chokes (12, 14), sources of fracturing fluid, a tubing or casing string of a well, a shotgun manifold (16), or other similar components. Any unused exterior ports can be blocked with a plug, cap, seal, or any similar member useable to close the unused ports.

The first five-way connector (18) is shown in communication with the primary choke (12). The primary choke (12) is further in communication with a tubing string of a well (not shown). A first exterior valve (44) is disposed between the primary choke (12) and the first five-way connector (18) for regulating the flow of fluid between the fractionation manifold (10) and the primary choke (12). The exterior valve (44) can be of the same or similar type of valve as the connector valves (22, 26, 30, 32), or of a different type able to control fluid flow between the fractionation manifold (10) and the primary choke (12).

The second five-way connector (20) is shown in communication with the secondary choke (14), with a bypass valve (46) disposed therebetween. The secondary choke (14) is in communication with the casing string of the well (not shown) disposed about the tubing string. The bypass valve (46) can be of the same or similar type of valve as the connector valves (22, 26, 30, 32), or of a different type able to control fluid flow between the fractionation manifold (10) and the secondary choke (14).

Through use of dual chokes (12, 14) in communication with both the tubing and the casing strings of a well, the fractionation manifold (10) is capable of an improved fluid flow rate compared to conventional fractionation manifolds. The secondary choke (14) can be used to flow excess fracturing fluid obtained through the casing of the well. By inducing a sandout in this manner, the secondary choke (14) is useable to prevent damage to the primary choke (12) that can be caused by repeatedly switching pressures from one side of the manifold (10) to the other, thereby reducing the possibility of cracking internal components of the chokes (12, 14). Additionally, the secondary choke (14) is useable as an auxiliary backup choke in instances when the primary choke (12) fails or is otherwise inoperable. The chokes (12, 14) are useable to transport return fluid from a well to suitable repositories, such as pickle return tanks, rig pits, or disposal sites, which can include depositing return fluid overboard from an offshore rig.

The third five-way connector (24) is shown in communication with a second exterior valve (46), which is useable to regulate the flow of fracturing fluid between the fractionation manifold (10) and a source of fracturing fluid (not shown). In an embodiment of the invention, the flow of fracturing fluid provided through the fractionation manifold (10) through the third five-way connector (24) can range from 30 barrels per minute to 35 barrels per minute.

In a further embodiment of the invention, a third exterior valve (48) can be in communication with the second five-way connector (20), for connecting the second five-way connector (20) to one or more sources of fracturing fluid (not shown), to provide an increased flow rate to the fractionation manifold (10). Use of both the second and third five-way connectors (20, 24) to flow fracturing fluid into the fractionation manifold (10) can enable the fractionation manifold (10) to flow fluid at a rate of 50 barrels per minute, or more. The exterior valves (46, 48) can be of the same or a similar type of valve as the connector valves (22, 26, 30, 32), or of a different type able to control fluid flow to or from the fractionation manifold (10).

FIG. 1 also depicts the shotgun manifold (16) in communication with the third and fourth five-way connectors (24, 28) of the fractionation manifold (10). The shotgun manifold (16) is useable to further increase the flow rate of the fractionation manifold (10) while adding only a minimum number of additional parts, requiring a minimal quantity of additional space, and utilizing the same power source that is used to power the fractionation manifold (10). Conventional fractionation systems instead require the addition of a second fractionation manifold with a second power source to provide an improved flow rate to the degree provided by the shotgun manifold (16).

Specifically, the shotgun manifold (16) is shown having a first additional five-way connector (50) and a second additional five-way connector (52), with a shotgun valve (54) disposed therebetween. The shotgun valve (54) can be of the same or a similar type of valve as the connector valves (22, 26, 30, 32), or of a different type able to control fluid flow between the additional five-way connectors (50, 52). The first additional five-way connector (50) is shown in communication with the fourth five-way connector (28) of the fractionation manifold (10), with a first shotgun connector (56) disposed therebetween. The second additional five-way connector (52) is shown in communication with the third five-way connector (24) of the fractionation manifold (10), with a second shotgun connector (58) disposed therebetween. While FIG. 1 depicts the shogun connectors (56, 58) as lengths of pipe or tubing, in an embodiment of the invention, the shotgun connectors (56, 58) can include valves useable to regulate the flow of fluid between the shotgun manifold (16) and the fractionation manifold (10).

The second additional five-way connector (52) of the shotgun manifold (16) is shown in communication with a fourth exterior valve (60), which enables communication between the shogun manifold (16) and one or more sources of fracturing fluid (not shown). The shotgun manifold (16), coupled the fractionation manifold (10) can provide the depicted fractionation system with a flow rate of up to 80 barrels per minute, or more.

Figure 3:
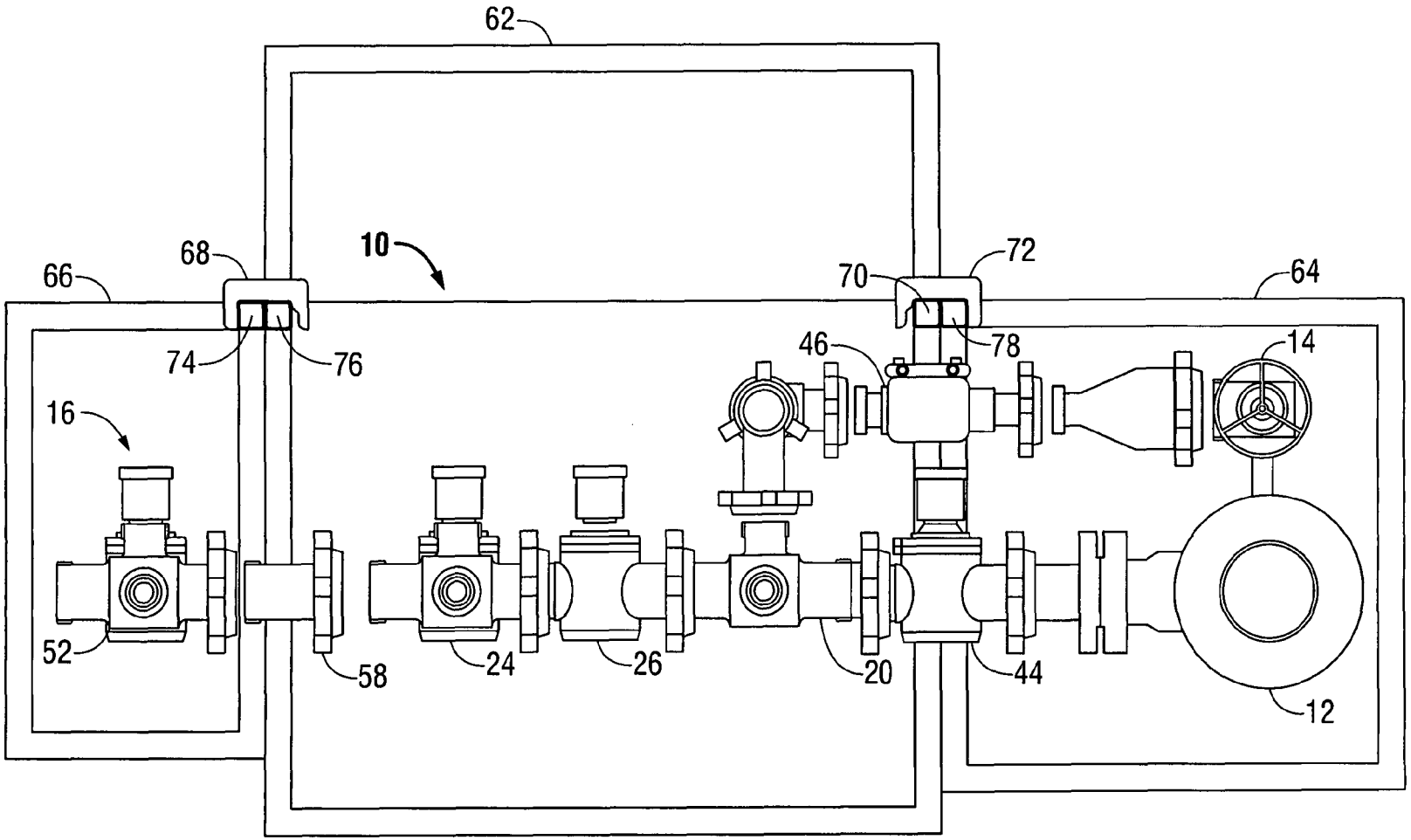
FIG. 3 depicts a diagrammatic side view of the fractionation system of FIG. 1 disposed within self-aligning, self-positioning skids.

Referring now to FIG. 3, a diagrammatic side view of an embodiment of a fractionation system of FIG. 1 is shown. Specifically, the fractionation manifold (10), chokes (12, 14), and shotgun manifold (16) are shown disposed within separate skid (62, 64, 66), which are alignable to facilitate installation of the system. It should be understood that while FIG. 3 depicts the fractionation manifold (10), chokes (12, 14), and shotgun manifold (16) within separate skids (62, 64, 66), various embodiments of the fractionation system can include a single, unitary skid, enabling the whole of the system, including any manifolds and/or chokes, to be lifted, placed, and installed as a single unit.

FIG. 3 depicts the fractionation manifold (10), of which the second five-way connector (20), third five-way connector (24), and second connector valve (26) are visible. The fractionation manifold (10) is disposed in a manifold skid (62), which can include any type of skid or similar frame of sufficient size to contain the fractionation manifold (10). The manifold skid (62) is shown including a first horizontal member (70) and a second horizontal member (76), which are useable to engage with and ensure proper alignment with adjacent skids.

FIG. 3 also depicts the primary choke (12) and the secondary choke (14) disposed in a choke skid (64) adjacent to the manifold skid (62). The primary choke (12) is shown in communication with the fractionation manifold (10) via the first exterior valve (44). The secondary choke (14) is shown having the bypass vale (46) disposed between the secondary choke (14) and the fractionation manifold (10).

The choke skid (64) is shown having a third horizontal member (78) secured to a second alignment hook (72). While only a single second alignment hook (72) is visible in FIG. 3, secured to the choke skid (64), any number of alignment hooks can be secured along the third horizontal member (78). The second alignment hook (72) is secured over the second horizontal member (70) of the manifold skid (62), such that the second and third horizontal members (70, 78) abut within the second alignment hook (72). The angle and/or shape of the interior of the second alignment hook (70) can be formed such that all connections between the fractionation manifold (10) and the chokes (12, 14) are aligned when the manifold skid (62) is engaged with the choke skid (64). Use of self-aligning skids enables the present fractionation system to be quickly installed by properly aligning and positioning all components efficiently, in a single attempt.

FIG. 3 also depicts the shotgun manifold (16), of which the second additional five-way connector (52) is visible. The shotgun manifold (16) is shown engaged with the fractionation manifold (10) using the second shotgun connector (58). The shotgun manifold (16) is disposed within a shotgun skid (66) having a fourth horizontal member (74). Secured to the fourth horizontal member (74) is a first alignment hook (68). While only a single first alignment hook (68) is visible in FIG. 3, secured to the shotgun skid (66), any number of alignment hooks can be secured along the fourth horizontal member (74).

The first alignment hook (68) of the shotgun skid (66) is shown secured over the second horizontal member (76), such that the second and fourth horizontal members (76, 74) abut. When the manifold skid (62) and the shotgun skid (66) are engaged in this manner, the fractionation manifold (10) and shotgun manifold (16) are properly aligned and positioned for all connections therebetween.

While FIG. 3 depicts alignment hooks (68, 72) secured to the shotgun skid (66) and the choke skid (64) for engagement with horizontal members of the manifold skid (62), it should be noted that other arrangements of alignment hooks are also useable, such as having one or more alignment hooks instead secured to the manifold skid (62) for engagement with the adjacent shotgun and/or choke skids (66, 64).

Figure 4:
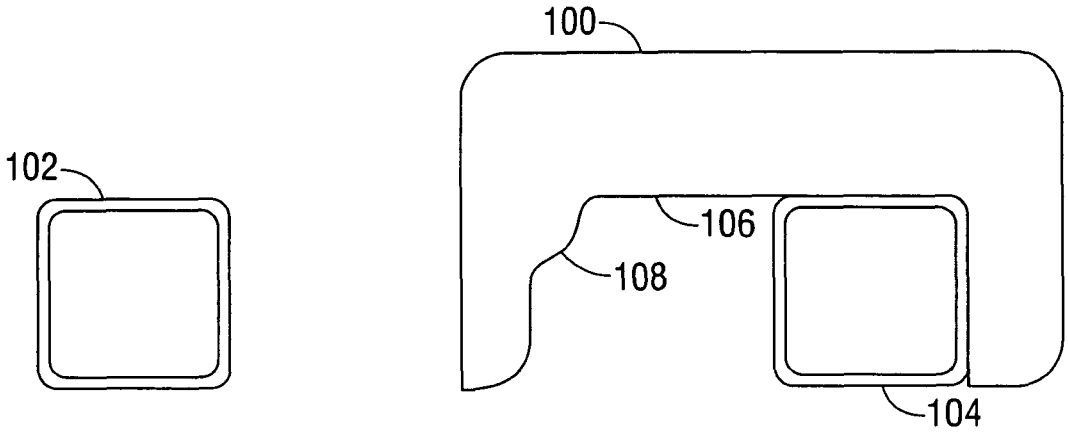
FIG. 4 depicts an embodiment of an alignment and positioning member of a skid in a disengaged position.
Figure 5:
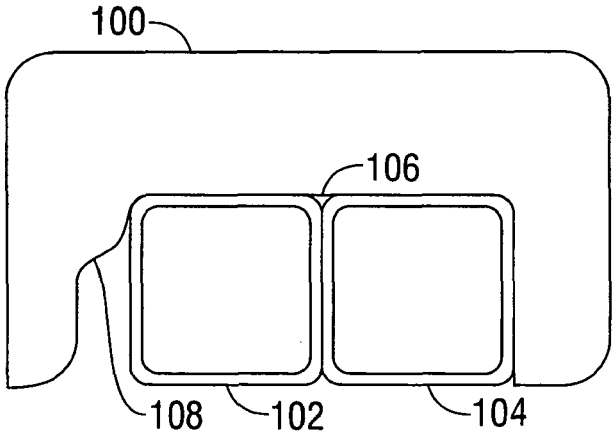
FIG. 5 depicts the alignment and positioning member of FIG. 4 in an engaged position.

For example, referring now to FIGS. 4 and 5, a diagram of an engagement between an alignment hook (100) and a second horizontal member (102) of a skid is shown.

FIG. 4 depicts the alignment hook (100) secured to a first horizontal member (104) of a first skid (not shown). A second horizontal member (102) of a second skid (not shown) is also depicted. The alignment hook (100) is shown having an interior surface (106) of sufficient length to contain both the first and second horizontal members (102, 104), such that the horizontal members (102, 104) abut when the alignment hook (100) engages the second horizontal member (102).

As the alignment hook (100) is lowered over the second horizontal member (102), the second horizontal member (102) contacts a curved or angled surface (108) along the interior surface (106) of the alignment hook (100). The curved or angled surface (108) guides the alignment hook (100) over the second horizontal member (71024) into position, such that both horizontal members (102, 104) are contained within the alignment hook (100) and substantially abut, ensuring the proper alignment and distance between components disposed within adjacent skids.

FIG. 5 depicts the alignment hook (100) engaged with the second horizontal member (102), such that the first and second horizontal members (102, 104) abut one another and are contained along the interior surface (106) of the alignment hook (100). The curved or angled surface (108) of the alignment hook (100) is useable to guide the second horizontal member (102) along the interior surface (106) into position. When the alignment hook (100) is engaged over the second horizontal member (102), the components disposed in the adjacent skids are properly aligned and positioned for set-up, thus saving time, energy, labor, and equipment when installing the present fractionation system.

Figure 6:
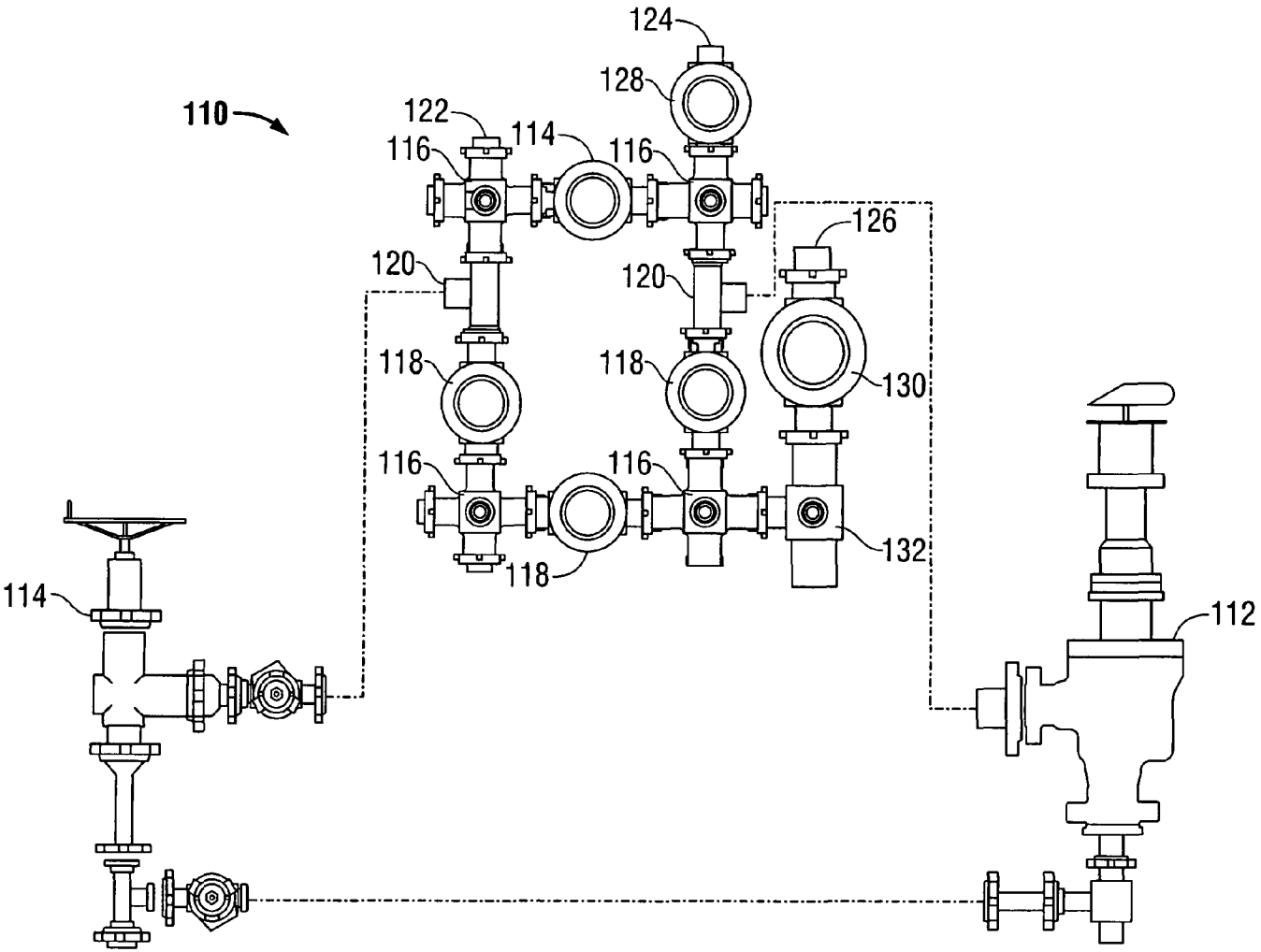
FIG. 6 depicts an alternate embodiment of a fractionation system useable within the scope of the present disclosure.

Referring now to FIG. 6, an alternate embodiment of a fractionation system useable within the scope of the present disclosure is shown. Specifically, FIG. 6 depicts a fractionation manifold (110), useable to perform a variety of functions relating to a fracturing operation at a well site that would normally require multiple manifolds. The fractionation manifold (110) includes a plurality of connectors (116), having valves (118) therebetween. Each of the valves (118) can be selectively actuatable, such as through use of a remote and/or wireless unit, to control the flow of fractionation fluid and return fluid throughout the fractionation manifold (110).

While the number, type, and configuration of connectors (116) and valves (118) can vary, depending on the available space at a well site and the desired operations of the fractionation manifold (110), FIG. 6 depicts the fractionation manifold (110) including four five-way connectors (116), such as that depicted in FIG. 2. The depicted embodiment of the fractionation manifold (110) is also shown including two three-way connectors (120), which respectively engage a primary choke (112) and a secondary choke (114). Further, the primary choke (112) is shown in fluid communication with the secondary choke (114). Each of the chokes (112, 114) can be controllable through a remote and/or wireless unit, in the same manner as each of the valves (118).

The ports of each of the connectors (116) not provided in fluid communication with adjacent connectors with a valve (118) are useable to flow fracturing fluid and/or return fluid into and from the fractionation manifold (110). For example, FIG. 6 depicts a first exterior port (122), a second exterior port (124) adjacent an exterior valve (128), and a third exterior port (126). FIG. 6 depicts the third exterior port (126) having a greater width than that of the other exterior ports (122, 124), the third exterior port (126) communicating with a valve (130) for regulating fluid flow therethrough. The third exterior port (126) is shown in fluid communication with the remainder of the fractionation manifold (110) through use of a four-way connector (132) having a width that exceeds that of the other connectors (116). For example, in an embodiment of the invention, the connectors (116, 120) and valves (118) of the remainder of the fractionation manifold (110) can have a diameter of three inches, while the four-way cutter (132) and third exterior port (126) can have a diameter of four inches.

The depicted embodiment provides an extremely portable configuration that occupies a minimum quantity of space on a rig floor. During normal operations, the depicted fractionation manifold (110) and chokes (112, 114) can be placed within a single skid, and transported and positioned through a single lifting operation. Coupled with the wireless capabilities of each of the valves (118, 128, 130) and chokes (112, 114), the depicted embodiment can be transported and installed in under two hours.

Embodiments of the present invention thereby provide a fractionation system able to be installed rapidly and efficiently, in a single lifting operation, or alternatively, using skids that enable proper alignment and positioning between components. The described systems and methods enable flow rates of up to 80 barrels per minute, or more, using only a single manifold and power unit, and can be wirelessly operated to provide improved safety, shortened installation times, and simpler operation. The disclosed fractionation system can be installed and assembled with any orientation, as necessary. Additionally, embodiments of the present systems and methods utilize two chokes to enable fluid flow on both the tubing side and the casing side of a well, which us useable to both improve fluid flow and to induce sandouts, providing significantly enhanced functionality over that of conventional manifolds While selected embodiments of the present invention have been described with emphasis, it should be understood that within the scope of the appended claims, the present invention can be practiced other than as specifically described herein.

What is claimed is:

1. A method for fracturing a well, the method comprising the steps of:

providing a fractionation system comprising:

a fractionation manifold comprising a plurality of connectors and a plurality of valves, wherein each of said connectors is in fluid communication with each other of said connectors, wherein at least one of said valves is disposed adjacent each of said connectors, and wherein the plurality of connectors defines a plurality of exterior ports;

a primary choke in communication with a first port of said plurality of exterior ports, wherein the primary choke is further in communication with a tubing string of the well;

a secondary choke in communication with a second port of said plurality of exterior ports and with the primary choke, wherein the secondary choke is further in communication with a casing string of the well, wherein the secondary choke is useable during sandouts, and wherein the secondary choke is further useable as a backup choke when the primary choke is inoperable, wherein a third port of said plurality of exterior ports is in communication with a fracturing fluid source, and wherein a fourth port of said plurality of exterior ports is in communication with a fluid repository;

introducing fracturing fluid sufficient to fracture the well from the fracturing fluid source into the fractionation manifold via the third port;

selectively actuating said plurality of valves to flow the fracturing fluid into the well; and selectively actuating said plurality of valves to flow return fluid from the well through the primary choke via the first port, through the secondary choke via the second port, or combinations thereof.

2. The method of claim 1, further comprising the steps of:

receiving a return fluid into the fractionation manifold from the tubing string via the primary choke and the first port, via the secondary choke and the second port, or combinations thereof; and selectively actuating said plurality of valves to flow the return fluid into a fluid repository via the fourth port.

3. The method of claim 1, further comprising the step of selectively actuating said plurality of valves to accommodate a sandout using the secondary choke via the second port.

4. The method of claim 1, further comprising the step of selectively actuating said plurality of valves to flow return fluid from the casing string via the second port and the secondary choke.

5. The method of claim 1, wherein the step of selectively actuating said plurality of valves comprises using at least one wireless unit in communication with said plurality of connector valves to control the connector valves.

6. The method of claim 1, wherein the fractionation system further comprises a manifold attachment in communication with the fractionation manifold for increasing the flow capacity of the fractionation system, the manifold attachment comprising at least one additional connector in fluid communication with the fractionation manifold, wherein said at least one additional connector defines at least one additional exterior port, the method further comprising the step of flowing fluid into or from the fractionation manifold through said at east one additional exterior port.

7. The method of claim 6, wherein the step of introducing fracturing fluid comprises flowing fracturing fluid through the fractionation manifold and the manifold attachment at a flow rate ranging from one barrel per minute to eighty barrels per minute.

* * * * *